US005609535A

United States Patent [19]

Morgan

[11] Patent Number: 5,609,535

[45] Date of Patent: Mar. 11, 1997

[54] METHOD OF RESTORING USED GOLF BALL

[75] Inventor: William E. Morgan, Barrington, R.I.

[73] Assignee: Acushnet Company, Fairhaven, Mass.

[21] Appl. No.: 359,212

[22] Filed: Dec. 19, 1994

Related U.S. Application Data

[63] Continuation of Ser. No. 910,816, Jul. 9, 1992, abandoned.

[51] Int. Cl.[6] ..... A63B 37/06; A63B 37/12

[52] U.S. Cl. ..... 473/409; 473/374; 473/378; 29/402.08; 29/402.18; 29/899; 156/146; 156/154; 156/98; 264/36; 427/140

[58] Field of Search ..... 473/409, 374, 473/378, 373

[56] References Cited

U.S. PATENT DOCUMENTS

| | | | |
|---|---|---|---|
| 1,911,569 | 5/1933 | Hinckley | 273/60 R |
| 2,015,165 | 9/1935 | Twiss et al. . | |
| 2,021,042 | 11/1935 | Bayon | 156/94 |
| 2,090,256 | 8/1937 | Heintz | 264/DIG. 74 |
| 3,216,058 | 11/1965 | Glaser | 273/235 R X |
| 3,419,949 | 1/1969 | Huebner | 29/402.11 |
| 4,256,304 | 3/1981 | Smith et al. | 273/60 B |
| 4,337,946 | 7/1982 | Saito et al. | 273/225 |
| 4,431,193 | 2/1984 | Nesbitt | 273/235 R |
| 4,904,320 | 2/1990 | Isaac et al. | 273/231 X |
| 4,919,434 | 4/1990 | Saito | 273/235 R |
| 4,991,851 | 2/1991 | Melesio | 273/213 |
| 4,998,734 | 3/1991 | Meyer | 273/235 R |
| 5,018,742 | 5/1991 | Isaac et al. | 273/235 A |
| 5,049,413 | 9/1991 | Gibson | 273/60 R X |
| 5,190,294 | 3/1993 | Oka | 273/232 |
| 5,390,932 | 2/1995 | Russo, Sr. | 273/220 |
| 5,427,377 | 6/1995 | Maruoka | 273/230 |

FOREIGN PATENT DOCUMENTS 2257916A 1/1993 United Kingdom .

*Primary Examiner*—George J. Marlo
*Attorney, Agent, or Firm*—Pennie & Edmonds

[57] ABSTRACT

A method of restoring a used golf ball in which a small portion of the old cover is removed and a new layer of material added, which new layer includes dimples. The new layer may be transparent with an indicia on its outer surface or on the outer surface of the remaining old cover.

12 Claims, 2 Drawing Sheets

METHOD OF RESTORING USED GOLF BALL

This is a continuation, of application Ser. No. 07/910, 816, filed Jul. 9, 1992, now abandoned.

BACKGROUND OF THE INVENTION

Constructions of golf balls have included cores and multiple layers on the cores including a layer for carrying indicia (U.S. Pat. No. 4,998,734). Such multiple layers have also included covers applied in layers (U.S. Pat. No. 4,337,946, U.S. Pat. No. 4,431,193 and U.S. Pat. No. 4,919,434).

It has also been proposed to place indicia on the core visible through a clear cover stock and clear final coat (U.S. Pat. No. 4,798,386).

SUMMARY OF THE INVENTION

Broadly, the present invention comprises a method of restoring a dimpled golf ball after use and the restored ball in which a small portion of the cover of the used ball is removed and a layer of cover material substituted for the removed cover portion.

It is a feature that the amount of removal of the old cover is relatively small but sufficient to remove substantially all of the dimples, as well as dirt, cuts, abrasions and surface coatings.

It is also a feature that indica may be placed on the remaining old cover portion and the new cover layer may be made of transparent or opaque material.

BRIEF DESCRIPTION OF THE INVENTION

FIG. 1 is a partial sectional view of a used golf ball;

FIG. 1*a* is a partial sectional view of a ball surface area showing paint, clear coat layers and indicia;

DESCRIPTION OF THE PREFERRED EMBODIMENT

Figure 1A:
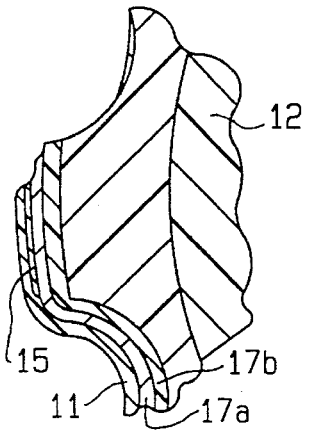
Figure 1:
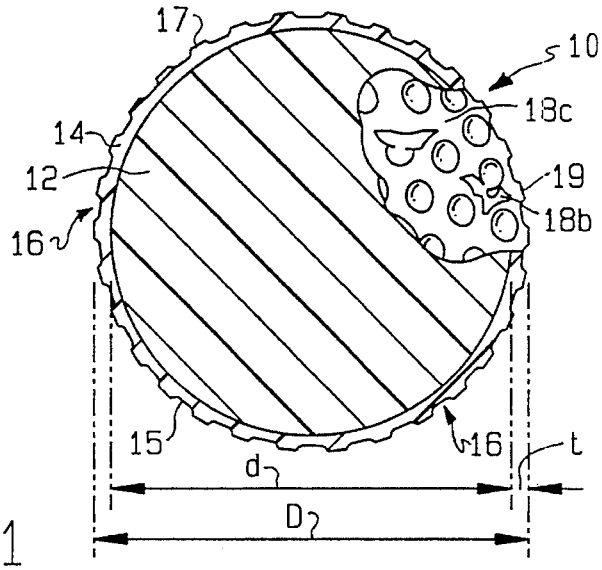
Figure 2:
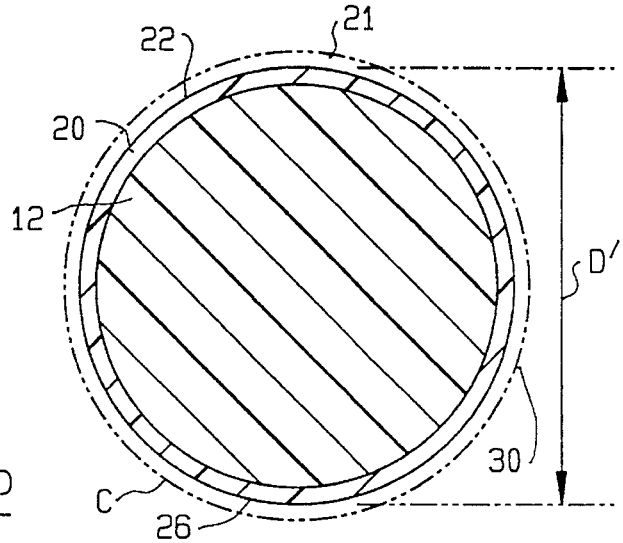
FIG. 2 is a sectional view of the used ball after removal of a portion of the cover including dimples.
Figure 3:
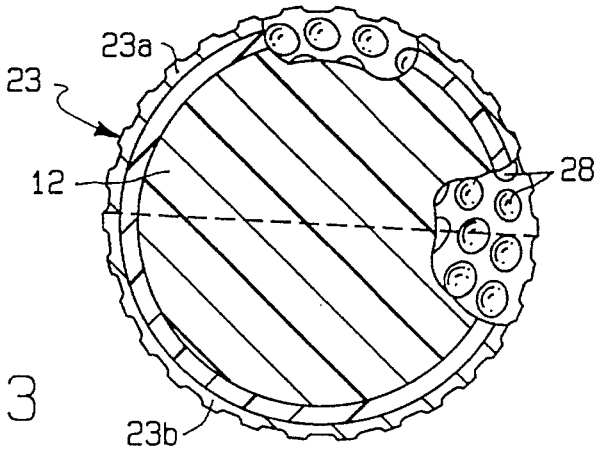
FIG. 3 is the restored ball after application of a layer of material to replace the portion of the cover removed.
Figure 4:
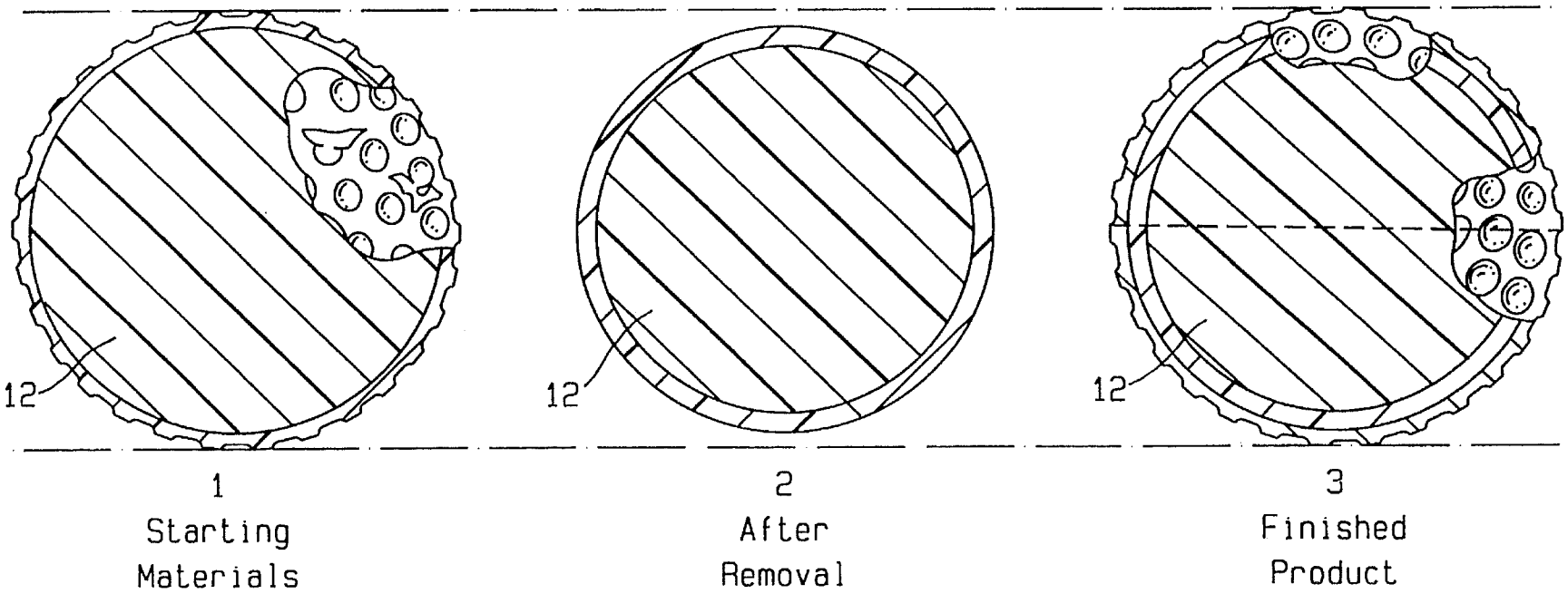
FIG. 4 illustrates the process steps for restoring a used golf ball.

Referring to FIGS. 1–3, used golf ball 10 of diameter D comprises a core 12 of diameter d and a cover 14 of thickness t with indicia 15, dimples 16 and a coat of paint 17 consisting of layers 17*a*, 17*b*. Ball 10 also has an exterior clear coat 11 (FIG. 1*a*). Ball 10, due to use, has a blemish 18*b*, a cut 18*c* and an area of paint 19 removed from cover 14. Core 12 has a diameter of about 1.600 to about 1.000 inches and cover 14 a thickness of about 0.090 to about 0.040 inch in thickness. The depth of dimples 16 is about 0.005 to about 0.012 inch. The overall diameter of ball 10 is 1.680 inches or larger in accordance with USGA rules.

To refurbish ball 10, approximately 0.015 of an inch or more of the cover is removed by a suitable method which would include, but is not limited to, grinding with a wheel or by tumbling in an abrasive. The removal of this outer portion 21 of cover 14 includes removal of all dimples 16 leaving remaining cover portion 20 (FIG. 2). The partially dashed line 30 in FIG. 2 shows the original used ball circumference C.

The new surface 22 which is smooth or alternatively abraded or textured or treated with an adhesive for promoting adhesion (having an overall diameter D' of 1.675 inches or less) is next printed with new indicia 26 such as a trademark and number. Thereafter there is added a new layer, preferably transparent, having a thickness such that the finished ball diameter is at least 1.680 inches and having new dimples 28. If an opaque layer is added the indicia is placed on the layer rather than surface 22. Layer 23 is preferably composed of two molded hemispheres 23*a*, 23*b* compression molded around ball 10. Alternatively, layer 23 can be injection molded on spherical surface 22 or cast on and around new surface 22.

While wound or solid core balls may be produced by the present method, solid core balls are preferred because they have longer life due to the nature of the core which enjoys longer service even in the environment of a golf course where old balls may reside until collected for treatment by the present method.

I claim:

1. A method of treating a golf ball having an exterior surface of a predetermined diameter, a core and a cover composed of cover material having a predetermined thickness and dimples and indicia on said exterior surface comprising:

(a) removing the entire exterior surface material of said cover and all said dimples and indicia to reduce the thickness of said cover and provide a dimple free and indicia free intermediate cover surface; and (b) adding to said intermediate cover surface a layer of cover material including dimples which is substantially equal in thickness to the material removed in step (a).

2. The method of claim 1 in which the added layer of cover material is transparent.

3. The method of claim 2, further comprising the step of applying indicia to the intermediate cover surface.

4. The method of claim 1 further comprising the step of smoothing the intermediate surface.

5. The method of claim 1 further comprising the step of forming abrasions on the intermediate surface.

6. The method of claim 1 further comprising the step of forming texture on the intermediate surface.

7. The method of claim 1 wherein the step of removing the exterior surface material comprises reducing the depth of the cover thickness to a second thickness that is less than the predetermined thickness.

8. The method of claim 7 wherein the step of removing the exterior surface comprises the step of grinding the exterior surface from the ball.

9. The method of claim 7 wherein the step of removing the exterior surface comprises the step of tumbling the ball in abrasive.

10. The method of claim 7 wherein the step of adding a layer of cover material is comprised of compression molding the layer of cover material to the intermediate surface.

11. The method of claim 7 wherein the step of adding a layer of cover material is comprised of injection molding the layer of cover material to the intermediate surface.

12. The method of claim 7 wherein the predetermined depth is about 0.09 to about 0.134 and the step of removing the exterior surface comprises the step of grinding approximately 0.015 of an inch from the cover.

* * * * *

UNITED STATES PATENT AND TRADEMARK OFFICE

CERTIFICATE OF CORRECTION

PATENT NO. : 5,609,535

DATED : March 11, 1997

INVENTOR(S) : William E. MORGAN

It is certified that error appears in the above-indentified patent and that said Letters Patent is hereby corrected as shown below:

Column 2, line 60 (claim 12, line 2), change "0.134" to --0.04--.

Signed and Sealed this

Tenth Day of June, 1997

*Attest:*

*Attesting Officer*

BRUCE LEHMAN

*Commissioner of Patents and Trademarks*